United States Patent [19]

Müllner et al.

[11] Patent Number: 4,561,883

[45] Date of Patent: Dec. 31, 1985

[54] METHOD OF PRODUCING METALS OR METAL ALLOYS AND AN ARRANGEMENT THEREFOR

[75] Inventors: Paul Müllner, Traun; Bernhard Enkner, Linz; Gerhard Hubweber, Frankenmarkt, all of Austria

[73] Assignee: Voest-Alpine Aktiengesellschaft, Linz, Austria

[21] Appl. No.: 638,640

[22] Filed: Aug. 7, 1984

[30] Foreign Application Priority Data

Aug. 18, 1983 [AT] Austria ..... 2954/83

[51] Int. Cl.[4] ..... C22B 4/00

[52] U.S. Cl. ..... 75/10 R; 75/12

[58] Field of Search ..... 75/10 R, 10 V, 12

[56] References Cited

U.S. PATENT DOCUMENTS

| | | | |
|---|---|---|---|
| 3,380,904 | 4/1968 | Goldberger | 75/10 R |
| 3,429,691 | 2/1969 | McLaughlin | 75/10 R |
| 3,684,667 | 8/1972 | Sayce | 75/10 R |

FOREIGN PATENT DOCUMENTS 1462056 11/1962 United Kingdom .

*Primary Examiner*—Peter D. Rosenberg
*Attorney, Agent, or Firm*—Brumbaugh, Graves, Donohue & Raymond

[57] ABSTRACT

In a method of producing metals or metal alloys by reducing their halides in a hydrogen plasma, a plasma jet reaction zone is built up from the vaporized metal halides contained in the plasma gas together with hydrogen, and the molten metal formed jets from the plasma jet reaction zone into a mould arranged therebelow. An arrangement for carrying out this method includes a reaction vessel whose upper part has a reaction space for the metal halide to be reduced and hydrogen-containing plasma gas, and a plasma lance arranged centrally in the reaction vessel, the metal formed getting into the lower part of the reaction vessel forming a metal sump therein.

15 Claims, 4 Drawing Figures

METHOD OF PRODUCING METALS OR METAL ALLOYS AND AN ARRANGEMENT THEREFOR

BACKGROUND OF THE INVENTION

The invention relates to a method of producing metals or metal alloys by reducing their halides as well as to an arrangement for carrying out the method.

The recovery of metals from their halides is particularly known for titanium, zircon, hafnium, niobium and tantalum. It may, however, also be used for other metals, such as, e.g., chromium and uranium. For the production of titanium the so-called Kroll method according to U.S. Pat. No. 2 205 854, is known, in which as starting materials, titanium tetrachloride and a reducing metal, namely magnesium or sodium, are used, and the titanium tetrachloride is introduced in the gaseous or the liquid form into a reaction crucible filled with a liquid reducing metal. The temperature is maintained at about 1100° K. Disadvantages of this method are that the reducing metal is expensive, the recovery of the metal from the metal halide is complex and the titanium is obtained in sponge form, thus requiring several steps of after-treatment.

A similar method is described in German Offenlegungsschrift No. 30 24 697, in which the reduction of the titanium tetrachloride is effected by the common action of sodium and hydrogen at temperatures of about 3000° K. The heat required for maintaining this temperature is obtained by exothermal reaction of the titanium tetrachloride with the reducing metal sodium, on the one hand, and, on the other hand, is produced by heating with an electric arc, a mirror burner, laser beams, or with plasma burners directed to the reaction zone. This method, too, has certain disadvantages, i.e. the use of the expensive reducing metal sodium and the great amount of energy necessary for vaporizing this reducing metal. Furthermore, problems result at the start, because measures must be taken which are difficult to carry out from the viewpoint of process technology in order to prevent obstructions of the supply ducts caused by the mutual diffusion of the reaction partners.

From German Auslegeschrift No. 1,295,194, a method for producing tantalum and/or niobium metal is known, in which the metal chlorides are introduced in solid form into a hydrogen plasma in the presence of a condensed dispersed heavy-metal carbide, with the reduced tantalum and/or niobium depositing on the heavy-metal carbide particles. This method is, however, not suited to be carried out on a technological scale.

SUMMARY OF THE INVENTION

The invention aims at avoiding the difficulties pointed out above and has as its object to enable the production of metals or metal alloys in the liquid form by reduction of their halides using hydrogen as reducing agent, yet without using reducing metals, such as sodium or magnesium, wherein the molten metal can be cast immediately thereupon.

This object of the invention is achieved in that a plasma jet reaction zone is formed from metal halides contained, in the vaporized state, in the plasma gas together with hydrogen, from which the molten metal formed thereby gets into a mould located below the reaction zone and, if desired, is continuously extracted therefrom.

By designing the reaction zone as a plasma jet reaction zone, a very high temperature as compared to the known method is obtained, namely up to 10,000° K. This thermodynamic effect is used advantageously since, the reducing power of hydrogen for metal halides increases with an increasing temperature, and the reduction of the halides thus can be effected without the help of additional reducing metals.

As the plasma gas, hydrogen alone may be used, but preferably a mixture of hydrogen and a noble gas, in particular argon, is used, wherein the temperature of the plasma jet (plasma column) can be controlled by the mixing ratio. Thus, the temperature can be raised by adding argon. The metal halide may be introduced into the plasma jet in the solid, liquid, or preferably gaseous state.

According to a preferred embodiment, additional hydrogen streams surrounding the plasma jet are introduced in order to conduct away from the reaction space the HCl formed and unreacted metal halides. The off gas produced during the reaction contains unreacted metal halides and HCl. The unreacted metal halides may be separated by cooling and may be led back in circulation to the plasma jet reaction zone.

According to the invention, the metal halides to be reacted are vaporized before they are introduced into the plasma jet reaction zone and preferably they are pre-reduced. For instance, titanium tetrachloride may be pre-reduced to titanium dichloride in a reaction chamber preceeding the plasma jet reaction zone.

The invention further comprises an arrangement for carrying out the method described, including a cooled reaction vessel in whose upper part a reaction space is formed into which the metal halide to be reduced and hydrogen are introduced, and which includes means for heating the reaction space, and in whose lower part the metal formed is collected.

According to the invention, the arrangement is characterized in that a plasma lance is arranged centrally in the reaction vessel, through which a mixture of hydrogen-containing plasma gas and the metal halide to be reduced are guided, a plasma jet being formed between the mouth of the plasma lance and the metal sump present in the reaction vessel as the counter electrode, in which plasma jet the reaction between hydrogen and metal halide takes place.

Further characteristics of the arrangement consist in that the reaction vessel is comprised of an upper reactor part containing the plasma lance, and a lower mould part which is telescopically displaceable relative to the upper reactor part and accommodates the metal sump; that the plasma lance is concentrically surrounded by hydrogen supply pipes; that the upper part and the lower part of the reaction vessel have double walls between which a coolant flows; that the displaceable parts of the reaction vessel are sealed relative to each other by a blocking gas, such as argon; and that the lower part of the reaction vessel is designed as a reciprocating open-ended mould.

BRIEF DESCRIPTION OF THE DRAWING

The method according to the invention and the arrangement for carrying it out are explained in more detail by way of the accompanying drawings, wherein.

DETAILED DESCRIPTION OF THE INVENTION

Figure 1:
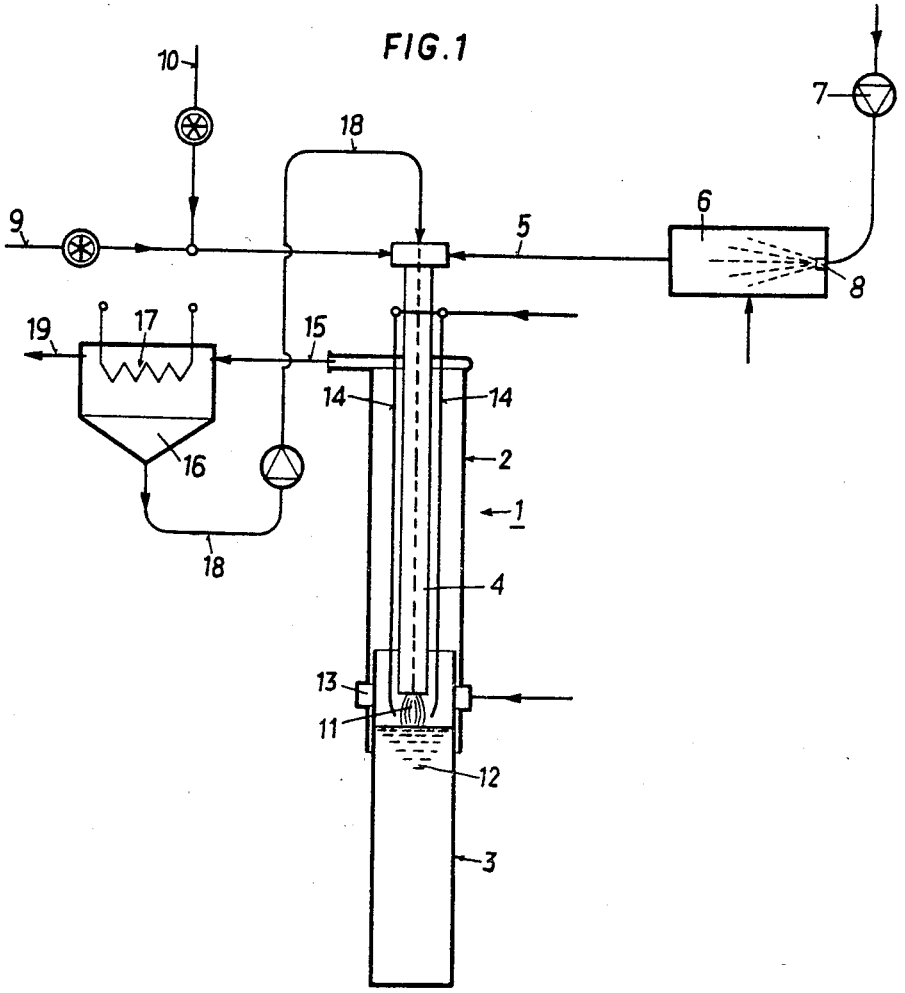
FIG. 1 is a schematic illustration of the method according to the invention.

Referring to FIG. 1, the reaction vessel is generally denoted by 1. It is comprised of an upper reactor part 2 and a lower mould part 3. Centrally in the reactor part 2 a plasma lance 4 is arranged, to which gaseous titanium tetrachloride is supplied via duct 5. The gaseous titanium tetrachloride is formed in a gasification chamber 6, which chamber is supplied by a dosing pump 7. The gasification or vaporization of liquid titanium tetrachloride is effected by injection into the chamber 6 via a nozzle 8 and simultaneous heating from the outside. Simultaneously the plasma lance 4 is supplied with plasma gas via ducts 9 and 10, which plasma gas is comprised of a mixture of hydrogen and argon. After the ignition of the plasma burner, a plasma column or plasma jet 11 forms at the mouth of the plasma lance, which has a high temperature of up to 10,000° K. and in which the reduction takes place. The molten metal is collected in the mould part 3. The plasma jet burns between the metal sump 12, which constitutes the anode, and the lance mouth. The mould part 3 is telescopically displaceable relative to the reactor part 2. The gap is sealed by a curtain of gas 13, preferably of argon. Around the plasma lance, further supply ducts, denoted by 14, for hydrogen gas are arranged. They guide additional hydrogen around the hot gaseous reaction zone and serve to remove the off gases formed, which consists of HCl and unreacted metal halides and possibly an excess of hydrogen from the reaction space and to press them from an off-duct 15 into a vessel 16 cooled by a cooling coil 17. By the cooling, HCl is separated from the unreacted metal halide, the unreacted metal halide is guided back into the plasma lance through duct 18. HCl is drawn off through duct 19.

According to a modified embodiment, the sketch of the method shown in FIG. 1 may be supplemented in that hydrogen is introduced into the gasification chamber 6 via a duct (not illustrated), wherein the titanium tetrachloride is pre-reduced to titanium dichloride. In this case, a cooling chamber may be provided in the duct 5 between the gasification chamber and the plasma lance from which the HCl formed during the pre-reduction is conducted away.

Figure 2:
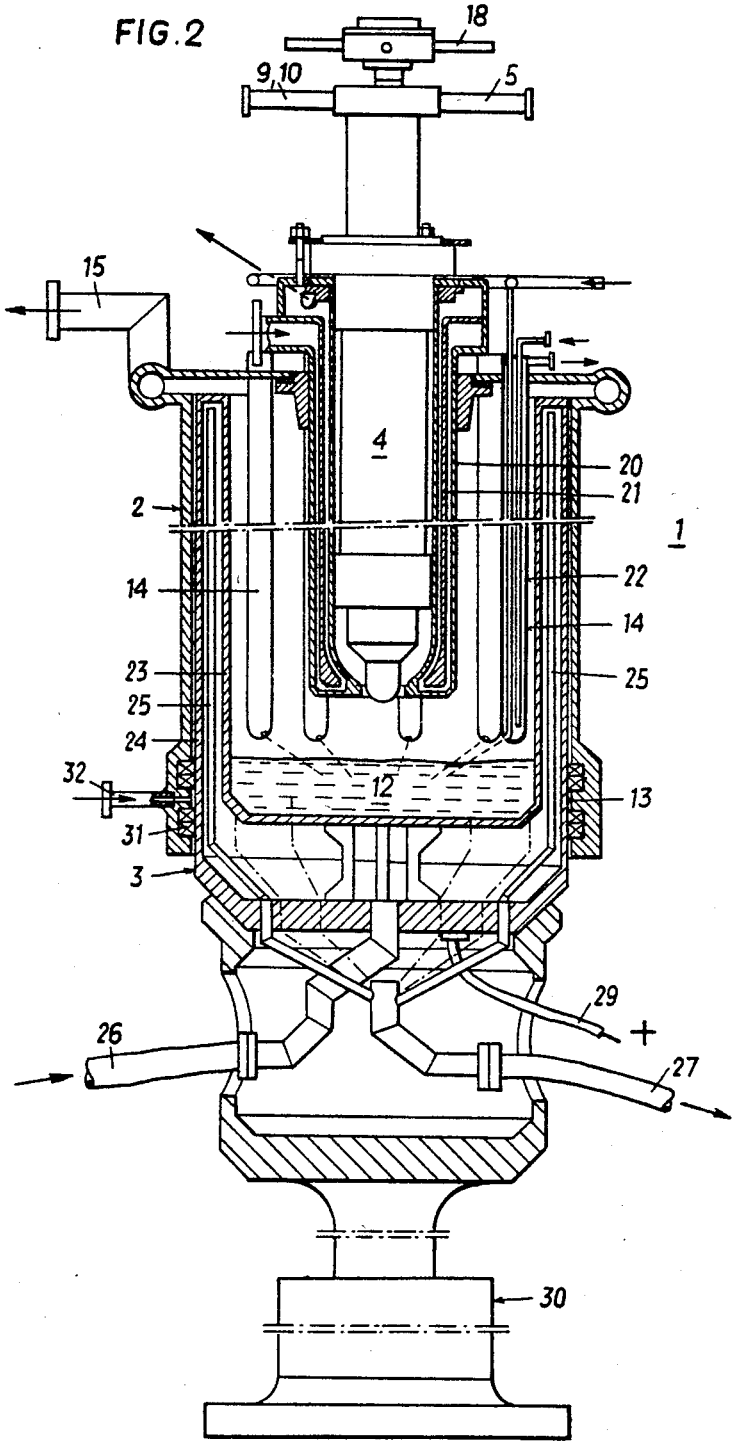
FIGS. 2 and 3 are partial vertical sections of a reactor with a connected mould part in two operating positions.
Figure 3:
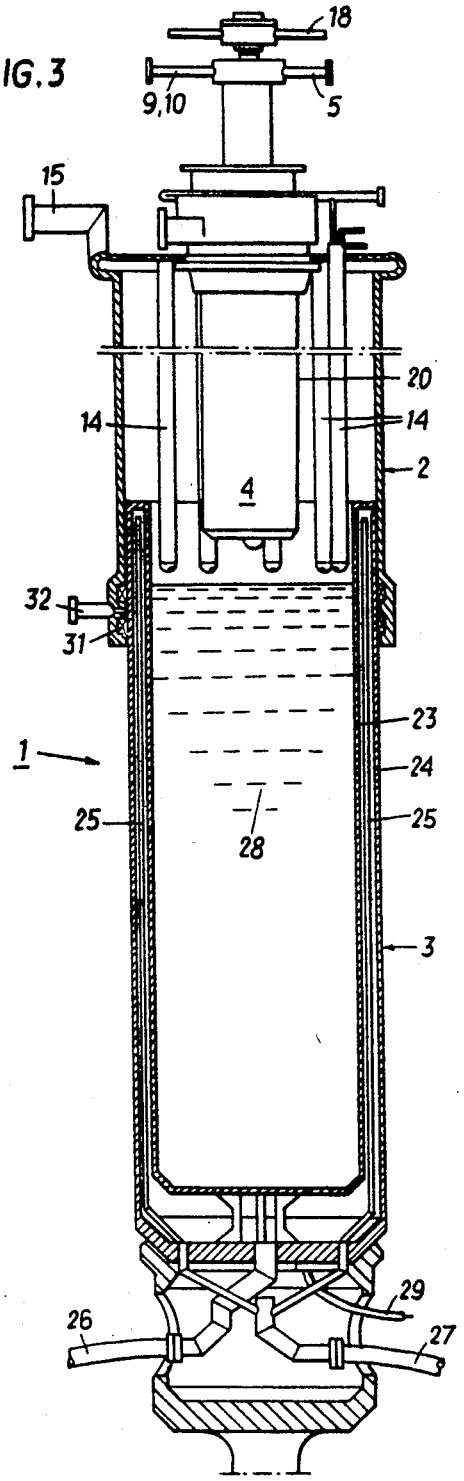

In FIGS. 2 and 3 the construction of the reaction vessel according to the invention is illustrated in more detail. It can be seen that the plasma lance 4 is cooled by a cooling jacket 20 in which a guiding duct 21 for guiding the flow of coolant is provided. Furthermore, the design of the supply pipes 14 for additional hydrogen surrounding the plasma lance can be seen from FIG. 2. The pipes 14 also are provided with cooling jackets 22. Furthermore, the mould part 3 of the reaction vessel is provided with a cooling system comprised of a double jacket 23, 24 and a ring of pipes 25 arranged in the jacket interspace. The coolant is supplied to the cooling jacket through duct 26, guided away through the pipes 25 arranged like a ring and conducted away through duct 27.

The mould part 3 is telescopically displaceable relative to the reactor part 2, i.e. it is retractible and extendable, FIG. 2 showing the retracted position at the onset or shortly after the onset of the reduction process, and FIG. 3 showing the position after the mould part has been filled with liquid metal 28 towards the end of the process. The mould part of the reaction vessel, which forms the anode, is electrically connected to the positive pole of a source of electric power by conductor 29. The plasma lance itself is the cathode and is connected to the negative pole of the source of electric power. The displacement of the mould part 3 relative to the reactor part 2 is effected by means of an adjustment member 30 engaging at the mould part. The gap between the reactor part 2 and the mould part 3 is sealed by a collar 31 into which argon is introduced through duct 32.

Figure 4:
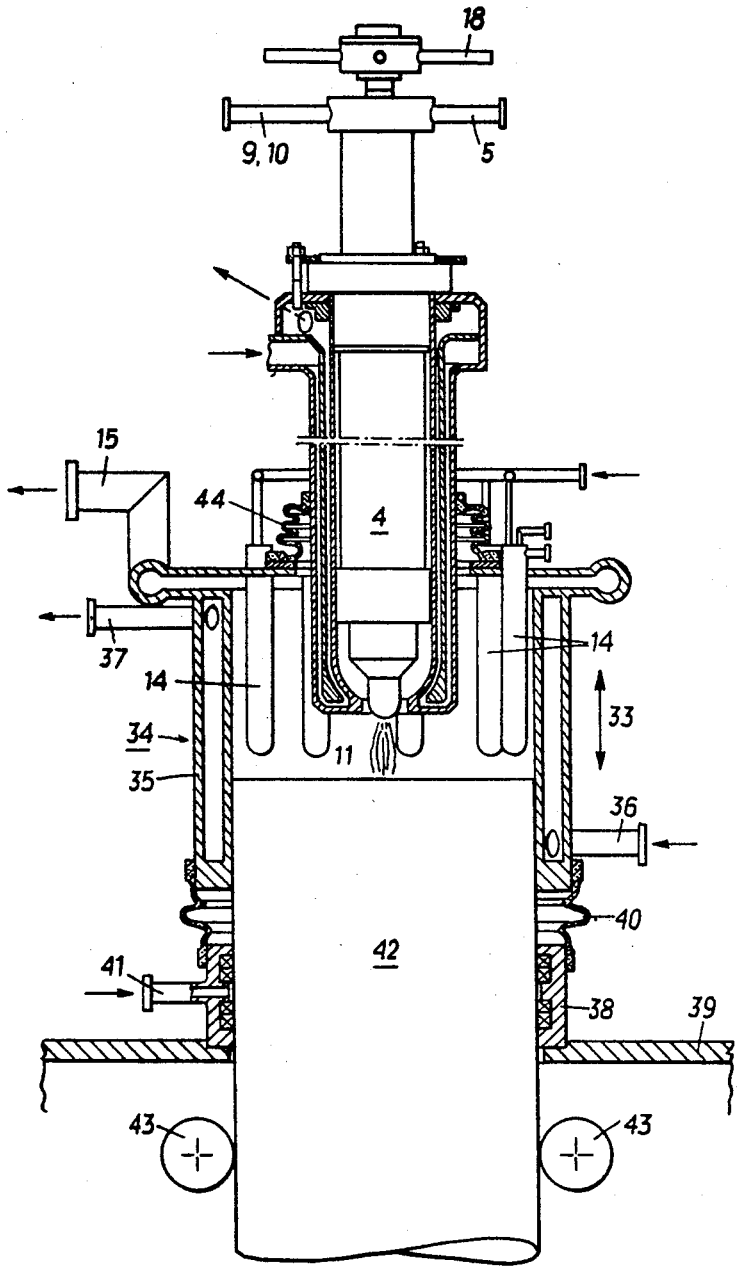
FIG. 4 shows a modified embodiment of a reactor with a reciprocating open-ended mould.

With the embodiment according to FIG. 4, the reactor part is formed by an open-ended mould 34 reciprocating in the direction of the double arrow 33 and provided with a cooling jacket 35 into which the cooling water enters at 36 and from which it emerges at 37. The plasma lance 4 and the pipes 14 arranged therearound for supplying additional hydrogen are designed in the same manner as described in connection with FIG. 2. By means of concertina walls 40 the open-ended mould 34 is connected relative to a stationary supporting part 38, which in turn is connected with the casting platform 39. For the purpose of sealing, argon is blown through duct 41 into the gap between the supporting part 38 and the strand 42 formed in the reduction zone 11 (plasma jet) in a similar manner as described before. The strand is continuously extracted by the rollers 43.

At the start of the process, at first the entire apparatus is flushed with noble gases, in particular argon. Afterwards the plasma lance is ignited, and the noble gas for the most part is replaced by hydrogen, and thereafter the metal halide is added. With the embodiment according to FIGS. 2 and 3, suitably a plate of the kind of metal to be produced is put onto the bottom of the mould part, to which the molten metal adheres and continues to grow as the reduction process continues.

With the embodiment according to FIG. 4, a starter bar of the metal to be produced is introduced from below into the mould at the start of the reduction process, which starter bar is downwardly extracted as the process continues. At the top the open-ended mould is sealed relative to the stationary plasma lance by further concertina walls 44 of electrically insulating material. The starter bar is connected to the positive pole, the plasma lance to the negative pole of a source of electric power.

The method according to the invention is illustrated in more detail by the following exemplary embodiments:

EXAMPLE 1

Into a reactor of the type illustrated in FIGS. 1 to 3, 4.3 kg of titanium tetrachloride and 8.9 $Nm^3$ of hydrogen were fed per hour, the reaction temperature being maintained at 4000° K. With this, 0.9 kg of titanium were obtained per hour. The molar ratio applied was a 4-fold molar excess of hydrogen relative to the HCl gas forming, and a 16-fold molar excess relative to titanium.

The energy consumption was 56 kWh, comprised of:

46 kWh for heating the hydrogen 7 kWh for heating the titanium tetrachloride, and 3 kWh reaction energy.

EXAMPLE 2

Into a reactor of the type illustrated in FIGS. 1 to 3, 4.3 kg of titanium tetrachloride and 5 $Nm^3$ of hydrogen were fed per hour, the reaction temperature being maintained at 4500° K. With this, 1 kg of titanium was obtained per hour. The molar ratio applied therein was a 2-fold molar excess of hydrogen relative to the HCl gas forming, and an 8-fold molar excess relative to titanium.

The energy consumption was 46.4 kWh, comprised of:

35.8 kWh for heating the hydrogen, 7.6 kWh for heating the titanium tetrachloride, and 3 kWh reaction energy.

EXAMPLE 3

Into a reactor of the type illustrated in FIGS. 1 to 3, 4.2 kg of titanium tetrachloride and 3 $Nm^3$ of hydrogen were fed per hour, and the reaction temperature was maintained at 5000° K. With this, 0.9 kg of titanium were obtained per hour. The molar ratio applied was a 1-fold molar excess of hydrogen relative to the HCl gas forming and a 4-fold molar excess relative to titanium.

The energy consumption was 35.2 kWh, comprised of:

23 kWh for heating the hydrogen 9 kWh for heating the titanium tetrachloride, and 3.2 kWh reaction energy.

What we claim is:

1. A method of producing a metal comprising the steps of:

creating a plasma jet reaction zone by establishing a plasma jet in a plasma gas including hydrogen and a vaporized halide of said metal wherein said metal halide is reduced and molten metal formed, and collecting the molten metal resulting from the reduction of the vaporized metal halide in said plasma jet reaction zone.

2. A method as set forth in claim 1, wherein said molten metal is collected in a mould arranged below said plasma jet reaction zone and further comprising the step of continuously extracting said molten metal from said mould.

3. A method as set forth in claim 1, further comprising the step of introducing additional hydrogen, in the form of streams surrounding said plasma jet reaction zone, for conducting away formed halogen acids and unreacted metal halides from said plasma jet reaction zone.

4. A method as set forth in claim 3, wherein said halogen acids and said unreacted metal halides conducted away form a gas mixture, further comprising the steps of cooling said conducted away gas mixture so as to separate said metal halides therefrom, and returning said metal halides to said plasma jet reaction zone.

5. A method as set forth in claim 1, further comprising adding a noble gas to said plasma gas for increasing the reaction temperature.

6. A method as set forth in claim 5, wherein said noble gas is comprised of argon.

7. A method as set forth in claim 1, further comprising the step of pre-reducing said metal halides to be reacted prior to introducing said metal halides into said plasma jet reaction zone.

8. An arrangement for producing a metal by reduction of a halide of said metal, comprising:

a reaction vessel having an upper part including a reaction space therein and a lower part providing a sump for the metal to be produced, means for cooling said reaction vessel, a plasma lance having a mouth at one end thereof extending centrally into said reaction vessel, means for supplying a mixture of hydrogen-containing gas and a vaporized halide of said metal to said lance and out of the mouth thereof as a plasma gas, and means including said plasma gas for forming a plasma jet between the mouth of said plasma lance and said metal sump, the hydrogen gas reacting with said vaporized metal halide in said plasma gas to produce said metal in molten state for collection in said metal sump.

9. An arrangement as set forth in claim 8, wherein said plasma lance extends into the reaction space of said upper part of said reaction vessel, and said lower part providing said metal sump comprises a mould part, said mould part being telescopically displaceable relative to said upper part.

10. An arrangement as set forth in claim 8 further comprising hydrogen supply pipes concentrically surrounding said plasma lance.

11. An arrangement as set forth in claim 8, wherein said reaction vessel is doubled walled and wherein there are further provided means providing a flow of coolant in the walls of said reaction vessel.

12. An arrangement as set forth in claim 9, further comprising means supplying a blocking gas for sealing said displaceable mould part of said reaction vessel relative to said upper part of said reaction vessel.

13. An arrangement as set forth in claim 12, wherein said blocking gas is argon.

14. An arrangement as set forth in claim 8, wherein said lower part of said reaction vessel comprises an open-ended mould, and wherein said reaction vessel is adapted to reciprocate vertically relative to said lance.

15. A method as set forth in claim 3, wherein said metal halide is titanium tetrachloride and said halogen acid is HCl.

* * * * *